United States Patent [19]

Etkin

[11] 4,213,852

[45] Jul. 22, 1980

[54] METHOD AND APPARATUS FOR PARTICLE CLASSIFICATION

[76] Inventor: Bernard Etkin, 44 Charles St. W., Toronto, Ontario, Canada, M4Y 1R8

[21] Appl. No.: 3,615

[22] Filed: Jan. 15, 1979

Related U.S. Application Data

[63] Continuation of Ser. No. 840,490, Oct. 7, 1977, abandoned.

[51] Int. Cl.[2] ..... B07B 4/02

[52] U.S. Cl. ..... 209/136; 209/149; 209/154; 73/432 PS

[58] Field of Search ..... 209/133, 134, 135, 142, 209/145, 156, 208, 209, 149, 32, 33, 3, 5; 73/147, 432 PS

[56] References Cited

U.S. PATENT DOCUMENTS

| | | | |
|---|---|---|---|
| 916,625 | 3/1909 | Stein | 209/33 |
| 1,581,242 | 4/1926 | Stebbins | 209/146 X |
| 3,385,436 | 5/1968 | Murphy | 209/135 |
| 3,933,626 | 1/1976 | Stukel et al. | 209/134 |

*Primary Examiner*—Ralph J. Hill

*Attorney, Agent, or Firm*—Hirons, Rogers & Scott

[57] ABSTRACT

Particles are classified according to their terminal velocities, which in turn are determined by their size, shape and composition, by dropping a mass of such particles into an air stream flowing in a direction making a substantial angle with the vertical, and having a high degree of uniformity and low turbulence, so that the particles assume trajectories determined by their terminal velocities. The distance downstream travelled by a particle is inversely proportional to its terminal velocity. Receptacles are provided at different downstream distances from the location of introduction of the material, below the flowing air stream, into which particles of different terminal velocities are collected.

10 Claims, 3 Drawing Figures

METHOD AND APPARATUS FOR PARTICLE CLASSIFICATION

This is a continuation of application Ser. No. 840,490 filed Oct. 7, 1977 now abandoned.

FIELD OF THE INVENTION

The invention relates to particle classification, and more particularly to a process and apparatus for classifying small particles from a mixture thereof according to their particle sizes or types.

BACKGROUND OF THE INVENTION

The need for classification separation of small particles from mixtures of two or more different types or sizes of such particles arises in many different industrial fields. For example, in minerals extraction processes, mineral ores are crushed and milled, and particles of the valued component thereof need to be concentrated and separated from the less valuable rock (the gangue). Powders are frequently used as raw materials for pigments, metals, molding sands, ceramics, foods, drugs and the like. To ensure the quality of these products, it is often necessary to analyse and control the particle size and particle size distribution of the powders. Methods and equipment by use of which particle sizes of powders could be determined, and mixtures of particles could be sorted according to size, in a rapid and efficient manner, would find a wide variety of applications in industry, both as laboratory instruments and processing aids.

BRIEF DESCRIPTION OF THE PRIOR ART

A wide variety of methods have been proposed and used in the past for these purposes. In the separation of various components of mineral ores, it is customary to crush and mill the ore to a finely divided granular product, and then subject the product to one of a number of separation or concentration processes, such as flotation. In flotation, the product is suspended in a liquid bath, and separation is effected according to whether or not the particle adheres to air bubbles rising through the chamber. Such flotation methods involve wetting the particles.

In other areas, various methods of separation by fluid motion have been used (liquid or gas). When discrete particles of varying sizes are introduced into a rising stream of constant and uniform velocity, particles below a certain size are carried away upwards while the coarser particles fall downwards. This effect is employed for the measurement of particle size. Stokes law gives a relationship between the velocity of the rising stream, the density of the solid material and the particle diameter of the equivalent spherical particle. For a homogeneous particle mass, one can readily calculate the flow velocity required to carry away all particles smaller than a given size. By using a range of different fluid flow velocities, the particle mass can be subdivided according to size, and the method can be used to determine particle size ranges or to separate particles of a given size. An apparatus which works upon this principle has been marketed for many years under the trade name "Infrasizer", by Infrasizers Limited of Toronto, Canada. In this instrument, a powder sample to be analyzed is placed in a vertically disposed tube, and a series of six other vertically disposed receiving tubes are provided, serially connected to the first tube at the top. An upwardly directed air stream blows particles of the sample upwardly through the top of the first tube, and deposits them in the appropriate receiving tube according to size, the lightest, smallest particles being carried to the remotest of the series of receiving tubes, the largest and heaviest remaining in the first tube. Whilst this apparatus is effective in particle separation, it is extremely time consuming (one hour is required for treating a 50 gm sample) and is adapted only for small scale use. It is inherently restricted to batch processing.

BRIEF SUMMARY OF THE INVENTION

It is an object of the present invention to provide a novel method and apparatus for separating particles according to "terminal velocity".

It is a further object to provide such an apparatus and process which will cause rapid and efficient particle separation, in a readily controlled manner, and on a large or small scale.

The present invention is based upon the principle that, when a single particle is introduced into a low turbulent or laminar gas flow stream which is moving in a horizontal direction, or in a direction which includes a significant horizontal component of motion, the particle is carried downstream by the flow through a distance which is inversely proportional to the terminal velocity of the particle. A given spherical particle falling freely through such a gas flow has a unique trajectory, determined by its terminal velocity, which is in turn determined by the size and density of the spherical particle. For non-spherical particles, their shape may also be a factor in determining their terminal velocities (e.g. the thinness of mica flakes). The present invention is also based upon the discovery that many particles can be introduced into such a gas flow without their mutual interference causing unacceptable deviations of the trajectories. By careful control of the air flow and of the method of introduction of the particles, a mass of particles can be divided into particles of discrete ranges, and the particles of a given range can be collected in suitable receptacles placed at increasing distances from the point of introduction. The particle collected in any receptacle differs from this in other receptacles by a combination of size, density and shape.

The present invention uses this principle of air flow separation of particles from one another according to size, density and shape in a controlled, scientific process for use with small particles, generally of sizes less than 1000 microns, and preferably less than 500 microns, by means of which particles may be graded and sorted, and by means of which mixtures of particles of different types may be separated and graded, and all of the separate fractions collected. The process and apparatus of the invention uses steady, controlled, low-turbulence fluid flow.

Thus according to a first aspect of the present invention, there is provided an apparatus for classifying a mixture of particles according to size, density and shape of the component particles of said mixture, which comprises:

a gas flow tunnel having an upstream end and a downstream end;

low-turbulence gas flow producing means located adjacent the upstream end of said tunnel, said gas flow producing means being adapted to produce substantially uniform gas flow of low-turbulence in the downstream direction and at a substantial angle to the vertical within said tunnel;

feeding means near the upstream end of said tunnel, and communicating with the upper portion of said tunnel, and adapted to feed particles into the upper portion of said gas flow tunnel;

a plurality of particle collection means disposed. along the bottom of the gas flow tunnel, serially arranged adjacent one another at increasing distances downstream from said introduction means.

The process and apparatus of the present invention can be used as a laboratory, analysis instrument, in which a given quantity of particles in a mixture is fed into the apparatus, classified and the various segments of the classified mixture recovered separately. Such a laboratory apparatus would be, for example, approximately six feet in length, and incorporate a wind tunnel of some 6–12 inches in depth. Such an apparatus effects very rapid separation of the particles. By varying the size of the collection means, namely their dimension in the direction of flow of the gas current, different fineness of classification can be arranged. Optimum gas flow rates for a given apparatus and a given type of particle are readily determined by simple routine experiments, or by prior calculation.

Alternatively, the process and apparatus of the present invention can be used as part of an overall industrial processing system, for continuous and automatic classification of particle mixtures. In such an arrangement, means are provided for continuously feeding the particle mixture to the feeding means of the apparatus, and extraction means are provided for continuously removing separately from the individual particle collection means the segments of the particle mixture so collected, and feeding them to the next stage of material processing.

BRIEF REFERENCE TO THE DRAWINGS

DESCRIPTION OF THE PREFERRED EMBODIMENTS

Figure 1:
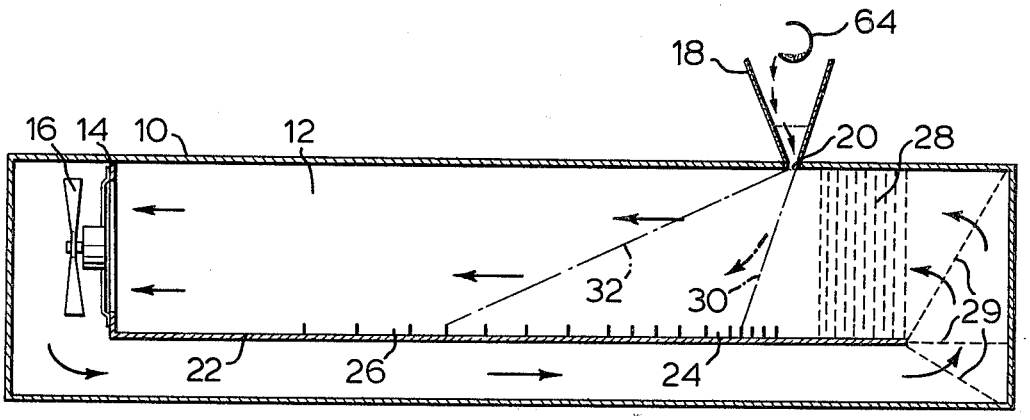
FIG. 1 shows, in diagrammatic cross sectional form, an apparatus according to the invention.

With reference to FIG. 1, an apparatus according to the invention generally comprises a rectangular section housing 10 provided with a low-turbulence flow chamber 12 extending along most of the length of its upper portion. The downstream end of the flow chamber 12 is defined by a vertically extending end wall 14 provided with an air extraction means such as a variable speed fan 16 for causing air flow at predetermined, adjustable velocity through the flow chamber 12. A particle inlet means 18 is provided near the upstream end of the laminar flow chamber 12, in the top wall of chamber 12, the inlet opening 20 thereof being narrow and extending substantially across the width of the chamber 12. The bottom wall 22 of the laminar flow chamber 12, from a position slightly downstream of inlet opening 20, to a position near the downstream end of chamber 12, is provided with a continuous series of containers or trays such as 24, 26, extending the full width across chamber 12 parallel to one another and adjacent to one another. The trays nearest to inlet opening 20 have a smaller dimension in the downstream direction than those furthest from the inlet.

At its upstream end, the flow chamber 12 is bounded by a set of screens 28 of known type, to produce uniform flow with substantial elimination of turbulence in chamber 12. Air is continuously circulated by fan 16 through chamber 12, around the bottom of chamber 12 beneath the bottom wall 22, through the screens 28 and back through flow chamber 12.

Additional screens 29 are included in the return duct in order to improve the uniformity of the flow in the flow chamber 12.

The particles to be classified are introduced into the air flow in chamber 12 through opening 20. They are merely allowed to fall into chamber 12 under gravity, and are not propelled therein. These particles are moved downstream in chamber 12 a distance determined by their terminal velocities. A first particle having a relatively high terminal velocity may assume trajectory 30, and hence be collected in tray 24. A second particle of lower terminal velocity may assume trajectory 32, and be collected in tray 26. If a homogeneous mixture of particles is initially introduced, so that all the particles have the same shape and density, the separation effected is solely on the basis of size. If a non-homogeneous mixture of particles is used, separation will be on a combination of size, density and shape, the variable components contributing to terminal velocity.

The types of particles with which the process and apparatus of the present invention can be used are, in general, any particles which do not agglomerate together to any significant extent, i.e. particles which in dry mass are substantially free running. Thus the particles should be non-sticky, relatively hard surfaced, and should be used in a dry condition. Examples of suitable such non-agglomerative particles include glass beads, various crushed mineral ores such as iron ore, copper concentrate and the like, mica flakes, silica sand etc. A visual inspection of a mass of the particulate material, to observe its tendency towards agglomeration, will normally indicate whether the material is suitable for use in the present invention. Alternatively the conducting of simple trials with an apparatus according to the invention will readily show the suitability or otherwise of the material for use therein.

As previously noted, it is important in the successful operation of the process according to the invention that the air flow with the chamber 12 be in a direction making a substantial angle with the vertical. Clearly, in order to cause separation, the air flow must be in a direction substantially different from the vertical fall direction of the particles. It is preferred that the chamber 12 be mounted in a substantially horizontal disposition and that the air flow therein be substantially horizontal. However, deviation from the horizontal can be tolerated for the air flow, provided that it makes a substantial angle with the vertical. As a practical matter, the direction of air flow should be at an angle of at least 30° to the vertical, horizontal flow being the most convenient.

In order that the particles assume their trajectories determined by their terminal velocities, on being dropped into the air flow stream, it is important that the flow be uniform and that turbulence in the air stream be at a low level. If at any given downstream distance from the point of introduction of the particles there are large variations in the flow rate at different positions across the cross section of the air flow stream, the separation based upon terminal velocities of the particles will be distorted. It is preferred, according to the present invention, to arrange for the flow rate, at any location across the cross section of the flow stream perpendicular to the direction of flow, at a given downstream distance from the point of entry of the particles, to be within 1% of the average flow rate at that downstream distance, to provide the necessary uniformity of flow. It will of course be understood that this degree of uniformity does not apply to the boundary layers adjacent the four walls of the tunnel. As is well known in aerodynamic systems, boundary layers exist adjacent flow tunnel walls, to which the flow characteristics elsewhere in the tunnel do not apply.

In addition, the flow within the chamber 12 should be of low turbulence so that the particles may assume the proper trajectories. The turbulence of the air flow is the fluctuation of the flow velocity with time, at a given point in the air flow. In the present case, the turbulence at a point in the air flow is the "RMS turbulence", namely the root-mean-square (RMS) of the velocity fluctuations at the point, per unit of the mean velocity of flow at that point. In the process of the present invention, the RMS turbulence should not exceed 10%, and should preferably not exceed 5%. For best results, the RMS turbulence should be of the order of 1% or less. The turbulence at any point in the stream is readily tested by use of a hot-wire anemometer, in the usual way.

In practice, air flows of the required uniformity and low turbulence can be achieved in a variety of ways. Air circulating means capable of substantially constant, steady operation at predetermined speeds should be used to create the air flow. The uniformity and low turbulence can be arranged by proper streamline design of the flow chamber. It is preferred, however, to pass the air flow through a plurality of metal screens, of various mesh sizes prior to entering the chamber, in order to achieve these desired flow characteristics. The use of screens for this purpose is well known, and permits one to avoid special streamline design of the chamber. It is preferred that the screens be removable and replaceable, so that they can be rearranged, if necessary, to provide the required uniform, non-turbulent flow, and so that they can be cleaned.

The air flow velocities which should be used in the process of the invention are to some extent dependent on the particles being separated and their terminal velocities, and also upon the air tunnel length. If the air speed is too great, the lighter particles, or those with lower terminal velocities, will be blown beyond the collection means. If the air speed is too low, insufficient separation will occur. The larger the particles, in general, the larger the tunnel speed. In general terms, the process of the invention operates best when the air flow speed is between about six times the terminal velocity of the lightest particle in the mass, and about one half the terminal velocity of the heaviest particle in the mass. In practice air flow speeds in the tunnel of from about 0.5 cm/sec to about 200 cm/sec are adequate for handling particles up to 1000 microns in size. Preferred air flow speeds are from about 3 cm/sec to about 120 cm/sec, these speeds being easy to attain without large expenditure of engergy, and relatively easy to obtain in the necessary uniformity and low turbulence.

In cases where a mass of particles having very wide extremes of particle terminal velocities therein, it may be found necessary or advantageous to subject the mass to two or more passes through the process using different air flow speeds. Thus, at the first chosen flow speed it may be found that classification into adequately small ranges only occurs for particles of low terminal velocities i.e. the smaller particles, whereas the larger particles are not effectively separated. In such case, the process should be repeated using only the mass of larger particles separated during the first pass through the process, but now using a higher air flow velocity, to continue the classification. In this way, with repeats of the process on parts of the classified mixture, fine subdivision of the particulate mass can be achieved.

In order that the particles may assume the trajectories determined by their terminal velocities, it is necessary to ensure that the interference of one particle with another during their introduction into and fall through the air flow be minimized as far as practical. For this purpose, the rate of feed of the particles into the tunnel should be controlled. It is preferred that the particles be introduced through an entrance slot which extends across the major part of the width of the tunnel, such as a width generally corresponding to the width of the uniform air flow in the tunnel, and stopping short of the non-uniform boundary layers adjacent the tunnel walls. The entrance slot should extend in a direction perpendicular to the downstream flow direction, the slot being narrow in the downstream direction. The rate at which the particles can be introduced, without causing substantial interference with one another, is theoretically independent of the slot width, in the downstream direction, and independent of the tunnel height, and can be up to at least about 100 g per minute per centimeter of slot length. There is no minimum feed rate, except as determined for reasonable rates of process performance. As the air flow velocity in the chamber is increased, the maximum feed rate permissible without causing excessive particle mutual interference increases. As the particle diameter increases, this maximum permissible feed rate increases. As the specific gravity of the particles increases, this maximum feed rate also increases. Specifically, a feed rate of about 7 g/min/cm of slot length has been found to work adequately for particles in the 100 micron size range, and specific gravity about 2, at flow rates of about 100 cm/sec. The geometry of the apparatus is also of some significance, particularly the ratio of slot width, in the downstream direction, to vertical height through which the particles fall. This ratio is preferably from about 1/200 to about 1/20.

In order to minimize particle interaction in the air flow chamber, it is preferred to feed the mass of particles into the air flow chamber from a line source, in the form of an elongated, triangular section trough, provided with sieves or screens, the bottom of which is slit to provide the line source. Passing the sample through sieves in this manner immediately prior to its entering the chamber assists in preventing particle agglomeration and interaction. It is preferred to agitate or vibrate the trough as the particles are fed. It is also preferred to feed the particles of the sample gradually to the trough whilst it is vibrating.

Figure 3:
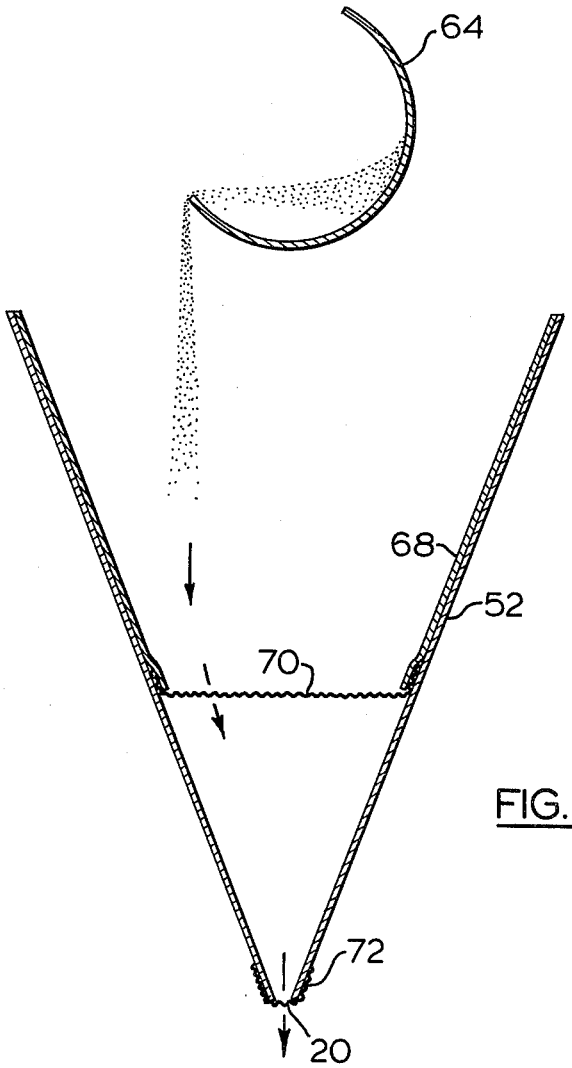
FIG. 3 is a detailed cross sectional view of a feed mechanism for introducing particles under test into the apparatus shown in FIG. 2.
Figure 2:
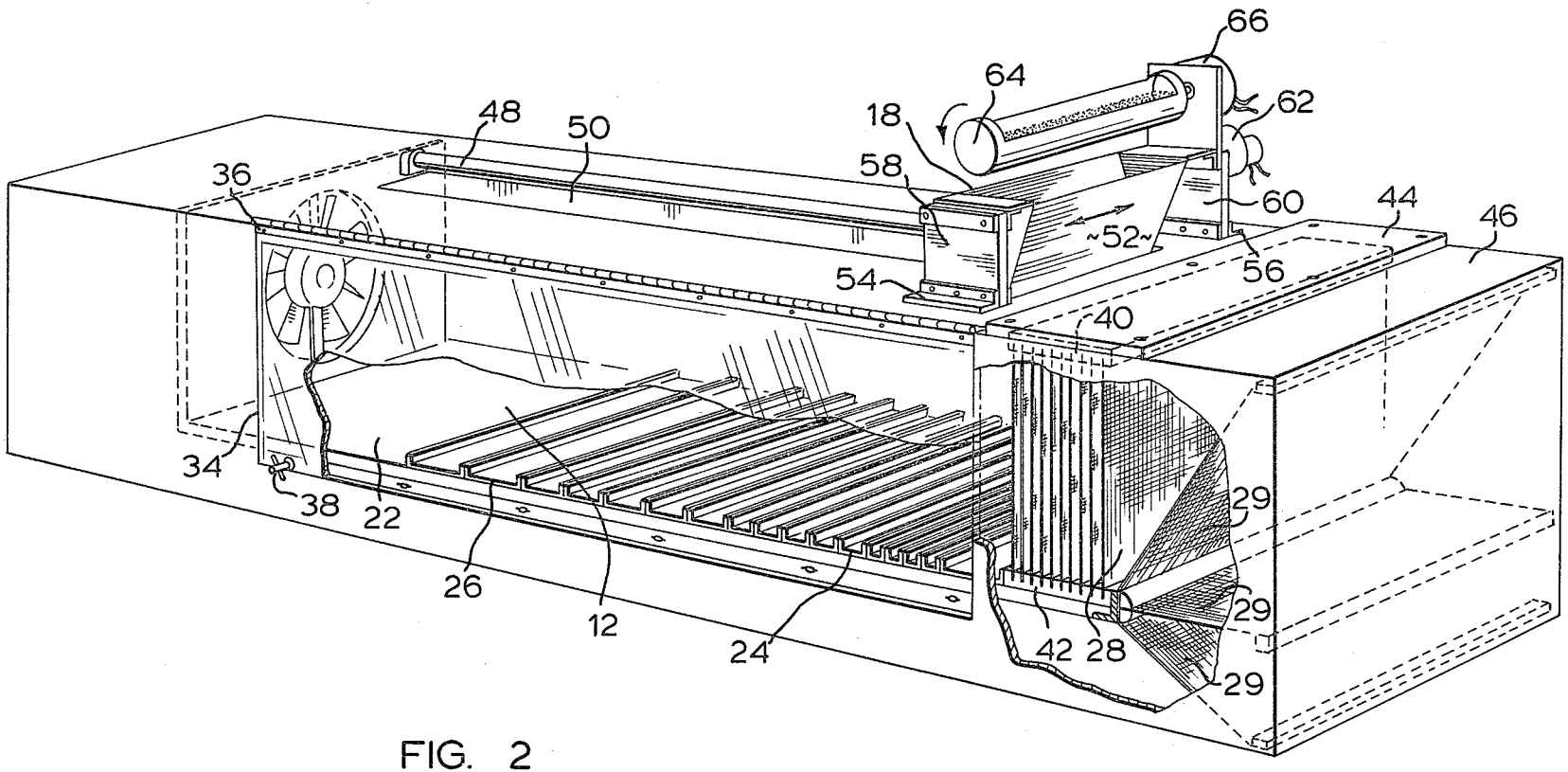
FIG. 2 is a perspective view, with parts cut away, of a practical apparatus according to the invention.

FIGS. 2 and 3 illustrate a specific form of apparatus according to the present invention. It will be seen from FIG. 2 that the apparatus is disposed generally horizontally, with the trays 24, 26 resting on the bottom wall 22 of the chamber 12 and extending parallel to one another across the tunnel width. The trays are merely placed on the bottom wall 22, and can be lifted out and rearranged as required. They are placed adjacent to one another so as to cover a section of the bottom wall 22 and catch all particles landing on that section. The front side wall 34 of the apparatus is of transparent material and is hinged along its top edge 36 so that it can be raised to provide access to the interior of chamber 12 to remove and rearrange trays 24, 26. Suitable releasable fasteners 38 are provided to hold the front wall 34 in its closed position to form a substantially air-tight front wall for the chamber 12 in operation.

The screens 28 at the upstream end of the chamber 12 are removably mounted in the vertical plane, parallel to one another, in a top holder 40 and a bottom holder 42 in the apparatus. A removable access cover 44 is provided in the top wall 46 of the apparatus, which access cover can be removed to allow removal and rearrangement of screen 28 to enhance or vary the air flow characteristics in chamber 12. Screens 29 in the return duct are semi-permanently mounted. An illumination means 48 namely a fluorescent tube light is provided in the top part of chamber 12, for observation of the apparatus and process in operation. A transparent screen 50 permits the light to enter the chamber 12.

The feeding means 18 is mounted on the top wall 46 of the apparatus, and comprises an elongated triangular sectional vibratory hopper 52, the side walls of which converge in the downward direction to define a narrow opening slot 20 at the bottom, at the height of the top wall 46 of the apparatus. The hopper 52 is mounted on the top wall 46 by means of brackets 54, 56 at its ends, the brackets including thick rubber mounting pads 58, 60 so that the hopper can vibrate end to end relative to the apparatus. A vibrating electric motor 62 is mounted on the rubber pad 60 so as to vibrate the hopper 52 in this manner.

Above the hopper 52 is mounted a rotating, cut-away feed tube 64 with an associated slow speed electric motor 66, adapted to rotate the feed tube 64 slowly above the hopper 52. In operation, granular material to be classified is deposited in feed tube 64, which is set slowly rotating whilst beneath it the hopper 52 is vibrating. As the feed tube slowly rotates, it slowly and gradually deposits the granular material into the hopper 52. The upper part of the hopper has double thickness walls, the inner layers 68 of which are removable. A screen 70 extends across the hopper 52 along its whole length, removably and replaceably clamped into position by the inner and outer hopper walls. The screen 70 vibrates with the hopper 52 so that particles are vibrationally screened on passing through the hopper, and excessively large particles or particle agglomerates are screened out. Another screen 72 covers the bottom opening or slit 20 of the hopper 52, which serves to give the particles another vibrational screening prior to entering chamber 12. Such a feeding arrangement of particles, through vibrational screens and a line introduction source at the bottom of a vibrating hopper, has been found in practice to be extremely beneficial in breaking up particle clusters and agglomerates, so as to give proper classification of particles according to the present invention.

The invention is further illustrated in the following specific practical examples.

EXAMPLE 1

A mixture of glass beads of various sizes was sorted and classified by a process according to the invention, using an apparatus generally as described with respect to FIGS. 1 and 2, except for the provision of a feeding means comprising a circular hopper from which the beads dropped onto a splash plate and thence into the wind tunnel chamber.

The glass beads had a density of 4 g/cc and ranged in size from about 50 to about 105 microns, being generally spherical in shape. They were fed to the wind chamber at a feed rate of 1.06 g/sec. The air speed in the chamber was 87 cm/sec. The vertical height from the entry point to the bottom wall of the wind chamber was 42 cm.

A series of trays was positioned along the bottom wall of the chamber as shown in FIGS. 1 and 2. At the conclusion of the experiment, it was found that the glass beads had been classified according to sizes in the trays, the largest of the beads being deposited in the tray nearest the point of introduction (tray 1). The contents of certain of the trays were analysed, by taking microphotographs and measuring the bead sizes on the photographs. Tray 1 contained beads of average diameter 108 microns, with a variation of ±4 microns. Tray 4 contained beads of average diameter 94 microns, with a variation of ±5 microns. Tray 8 contained beads of average diameter 79 microns, with a variation of ±4 microns. Tray 12 contained beads of average diameter 44 microns, with a variation of ±5 microns.

EXAMPLE 2

In this example, dry mica flakes 200-H were classified according to the invention, using an apparatus as illustrated. The mica flakes were screened through a 53 micron (270 mesh) screen, so as to divide them into two types. Each type was then classified according to the invention, using an air speed in the chamber of about 3 cm/sec. and the contents of the individual trays observed by photomicrographs.

In each case, the photomicrographs showed that the trays near the inlet collected thicker flakes, whereas the thinner flakes were collected in the downstream trays.

EXAMPLE 3

In this example, a 260 g sample of iron ore, containing Magnetite, Hematite and Silica, sufficiently finely divided to pass a 35 mesh screen, was classified according to the invention using an apparatus as illustrated. The air speed in the chamber was about 20 cm/sec. Microphotographs were taken of the contents of various trays, and showed a high degree of consistency of particle size in each tray. Typical particle size diameters in the various trays (the trays being numbered from the inlet) were as follows:

| Tray No. | Typical Particle Diameter (μ) |
|---|---|
| 1 | 238 |
| 4 | 120 |
| 8 | 83 |
| 20 | 48 |
| 28 | 36 |

What I claim is:

1. Apparatus for classifying a mixture of particles according to size, density and shape of the component particles of said mixture, which comprises:

a gas flow tunnel having an upstream end and a downstream end;

a return conduit connecting the downstream end of the gas flow tunnel to the upstream end thereof, said return conduit and said gas flow tunnel being arranged adjacent to and generally alongside one another and communicating with one another at the upstream end of the gas flow tunnel to form a gas circulation duct;

a gas recirculation means in said return conduit to circulate gas through the gas flow tunnel and through the return conduit, the gas flow directions in the gas flow tunnel and in the return conduit being substantially opposed to one another;

a plurality of low turbulence gas flow-producing screens located in the path of air flow adjacent the upstream end of said gas flow tunnel and in the return conduit where it communicates with the gas flow tunnel and where the circulating gas therein changes its flow direction on passing from the return conduit to the gas flow tunnel, the upstream ones of said screens in the return conduit being angularly disposed with respect to one another, said screens being adapted to produce substantially uniform gas flow in the downstream direction and at a substantial angle to the vertical of RMS turbulence not greater than about 1%, with said tunnel;

feeding means near the upstream end of said tunnel, and communicating with the upper portion of said tunnel, and adapted to feed particles into the upper portion of said gas flow tunnel;

a plurality of particle collection means disposed along the bottom of the gas flow tunnel, serially arranged adjacent one another at increasing distances downstream from said feeding means.

2. Apparatus according to claim 1, wherein the particle collection means extend across the full width of the bottom of the gas flow tunnel in a direction transverse to the gas flow.

3. Apparatus according to claim 1, wherein the gas flow tunnel is rectangular in cross-section, and the particle collection means comprise elongated trays extending mutually parallel to one another in side by side relationship transversely to the direction of gas flow across the bottom of the gas flow tunnel.

4. Apparatus according to claim 3, wherein the feeding means comprises an elongated vibrating screened hopper having a narrow feed slit in the bottom thereof, said feed slit opening into and extending substantially the full width of the feed tunnel.

5. Apparatus according to claim 4, wherein the ratio of the feed slit width, in the downstream direction, to the vertical height of the wind tunnel at the location of the hopper is from about 1/200 to about 1/2000.

6. A process of classifying a mixture of particles according to size, density and shape of the component particles of said mixture, which comprises:

circulating air through an air flow tunnel and a return air flow conduit connecting the downstream end of the air flow tunnel to the upstream end thereof, the direction of air flow in the air flow tunnel and in the return conduit being substantially opposed to one another;

passing the circulating air through a plurality of low turbulence gas flow-producing screens as the air flow changes direction on passing from the return conduit in the upstream end of the air flow tunnel so as to produce a substantially uniform air flow of RMS turbulence not greater than about 1%, said air flow being in a direction at a substantial angle to the vertical;

dropping said mixture of particles into said substantially uniform air flow at a location downstream of said screens;

permitting the particles to fall and assume a falling trajectory under gravity in said air flow into discrete collection zones at varying horizontal distances downstream of the point of introduction of the particles into the air flow;

and collecting the particles separately from the collection zones.

7. The process of claim 6, wherein the air flow is generated in a wind tunnel, and the particles are dropped into the top of the wind tunnel near the upstream end thereof, in a narrow band extending across the width of the wind tunnel transverse to the direction of flow therein, the wind tunnel being in communication with the outside atmosphere at the point of introduction of the particles into the air flow.

8. The process of claim 6, wherein the particles of the mixture have a size of 1000 microns or less.

9. The process of claim 8, wherein the air flow speed in the wind tunnel is from about 0.5 cm/sec to about 200 cm/sec.

10. The process of claim 8, wherein the particles are selected from the group consisting of glass beads, crushed mineral ore, mica flakes and silica sand.

* * * * *